US006615432B1

(12) United States Patent
Blaylock

(10) Patent No.: US 6,615,432 B1
(45) Date of Patent: Sep. 9, 2003

(54) MOVABLE STAND TO ASSIST A PERSON FROM A LYING OR SITTING POSITION TO A SITTING AND/OR STANDING POSITION

(76) Inventor: Cindy L. Blaylock, 20192 Bayview Ave., Newport Beach, CA (US) 92660

( * ) Notice: Subject to any disclaimer, the term of this patent is extended or adjusted under 35 U.S.C. 154(b) by 0 days.

(21) Appl. No.: 10/201,695

(22) Filed: Jul. 24, 2002

(51) Int. Cl.[7] ..... A61G 7/053
(52) U.S. Cl. ..... 5/662; 5/81.1 R
(58) Field of Search ..... 5/81.1 R, 662; 135/66, 84; 4/560.1

(56) References Cited

U.S. PATENT DOCUMENTS 2,757,388 A * 8/1956 Chisholm ..... 5/507.1
2,963,713 A * 12/1960 Forrest ..... 5/507.1
3,604,019 A 9/1971 Garner
4,932,090 A 6/1990 Johansson
5,048,131 A 9/1991 Stephen
5,054,137 A 10/1991 Christensen
5,189,741 A * 3/1993 Beardmore ..... 5/86.1
5,354,022 A * 10/1994 Coonrod ..... 248/127
5,435,028 A * 7/1995 Frala ..... 5/662
5,507,044 A * 4/1996 Williamson et al. ..... 5/81.1 RP
5,560,053 A 10/1996 Mills
6,044,507 A * 4/2000 Smith ..... 5/662
6,213,435 B1 4/2001 Minet
6,276,007 B1 * 8/2001 Brown ..... 5/81.1 R

* cited by examiner

*Primary Examiner*—Michael Trettel
(74) *Attorney, Agent, or Firm*—Edgar W. Averill, Jr.

(57) ABSTRACT

A process for a caregiver using a movable stand to assist a reclined person to move from a reclined position to a sitting and/or standing position. The process includes the process of moving a movable stand which has a floor contacting base which supports a vertical pole. The stand is moved to a place adjacent the reclined person. The caregiver places at least one foot on the floor contacting base and grasps an upper portion of the generally vertical pole. The reclined person grasps an intermediate portion of the pole and pulls on the pole to assist the reclined person to sit or stand without placing a strain on the back of the caregiver.

5 Claims, 2 Drawing Sheets

MOVABLE STAND TO ASSIST A PERSON FROM A LYING OR SITTING POSITION TO A SITTING AND/OR STANDING POSITION

BACKGROUND OF THE INVENTION

The field of the invention is caregiving apparatus and the invention relates more particularly to apparatus which assists a handicapped person to get out of a bed, physician's bench, chair, couch, or from any lying or seated position to a sitting and/or standing position. For persons who are not severely handicapped, this is typically accomplished simply by the caregiver extending a hand under the upper back or shoulders of a reclined person to assist the person to a seated position. Occasionally, this is also accomplished by the patient pulling on the caregiver's arm and putting undue strain on the caregiver's back or arm. After the patient is seated, the patient is pulled in a forward direction and somewhat upwardly so that the seated person can move to a standing position. While this is a simple and common process, it actually can seriously injure the back of the caregiver because of the upwardly and forwardly directed force exerted on the upper body of the caregiver which is transferred to the lower spine of the caregiver. As a result, a significant number of caregivers are injured by this simple step and a better method is needed to reduce the injuries caused thereby.

Numerous devices have been patented to assist invalids. One such device is shown in U.S. Pat. No. 3,604,019 designed to assist a person into and out of a bathtub. The device includes a base which is affixed to th floor adjacent the tub. A series of handles are available for the bather to use in getting in and out of the tub.

U.S. Pat. No. 4,932,090 shows a movable support bar which is also affixed to the floor or to a bed with a handle which the invalid can use to help move position to a standing position.

U.S. Pat. No. 5,048,131 shows an adjustable assist stand to assist someone into or out of a spa. It has a base plate which is secured to the floor and a telescoping vertical portion.

U.S. Pat. No. 5,054,137 shows a device which is used to help maneuver a physically impaired person. The physically impaired person stands on the base of the unit and rises to a standing position. The base unit then may be rotated so that the impaired individual may sit in a wheelchair or in a position rotated from his or her original seated position.

U.S. Pat. No. 5,560,053 shows a stand which has a base which supports a vertical pole which includes a horizontal pivot assembly. The device may be situated adjacent the disabled person's bed so that the disabled person may be moved from a wheelchair to a bed without assistance, or from a bed back to the wheelchair without assistance.

U.S. Pat. No. 6,213,435 shows another device for aiding a bedridden patient to leave the bed. It may be affixed to the bed and has handles or grips for the patient and may be adjusted to an appropriate height by affixing a telescoping member to the desired height.

While the above devices are useful to move a physically handicapped person from a commonly used location, such as a bed or a bathtub. Such devices are not useful for the situation more common for slightly less disabled persons, such as moving from any of a plurality of beds, benches, couches, or chairs in a room to a sitting and/or standing position. Most of the prior art devices are either permanently affixed to the floor or are so large and bulky as to be impractical to move easily to a particular chair in a room.

BRIEF SUMMARY OF THE INVENTION

It is an object of the present invention to provide a process for assisting an impaired person from where the impaired person is lying down or seated to a sitting and/or standing position.

The present invention is for a process for a caregiver using a movable stand to assist a reclined or seated person to move from a reclined or seated position to a sitting and/or standing position. The movable stand has a floor supported base plate having a floor contacting bottom and a foot contacting upper surface. The floor supported base plate holds a generally vertically pole which extends upwardly from the base plate. The process includes a step of moving the movable stand to a position in front of the reclined person. Next, the caregiver places at least one foot on the foot contacting upper surface of the floor supported baseplate. The caregiver then grasps an upper portion of the generally vertical pole. The reclined or seated person grasps an intermediate portion of the pole and pulls on the pole to assist the reclined person to a sitting or standing position without placing a strain on the back of the caregiver. The vertical pole is mounted near the front edge of the floor supported base plate.

DESCRIPTION OF THE PREFERRED EMBODIMENTS

Figures 1, 2:
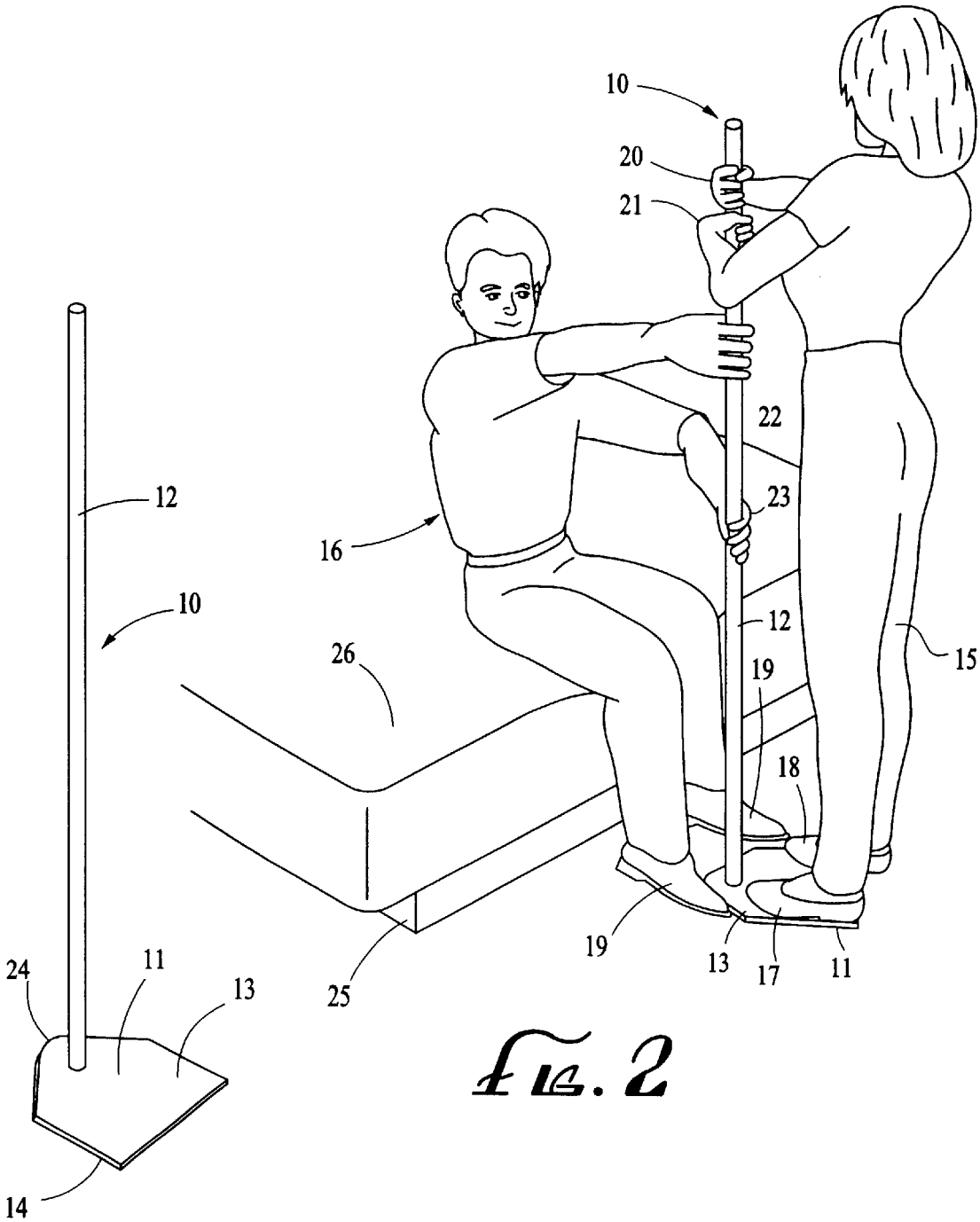
FIG. 1 is a perspective view of the movable stand useful in the process of the present invention.
FIG. 2 is a perspective view of a seated person and a caregiver utilizing the movable stand of FIG. 1 to assist the seated person to rise to a standing position.

The movable stand used in the process of the present invention is shown in perspective view in FIG. 1 and indicated by reference character 10. Movable stand 10 has a floor supported base plate 11. Base plate 11 is not attached or affixed to the floor, but instead is deliberately movable so that a caregiver can easily move it to wherever the reclined or seated person may be located. For instance, in a living room area of a nursing home, a single movable stand can be kept in the corner of the room and moved to wherever a reclined or seated person needs assistance. Movable stand 10 is preferably fabricated from a lightweight material, such as aluminum or wood, and if aluminum, would have a hollow central vertical pole 12 which is light in weight and yet sufficiently strong for the required purpose. Floor supported base plate 11 has a foot contacting upper surface 13 and a floor contacting bottom 14.

Figures 3, 4:
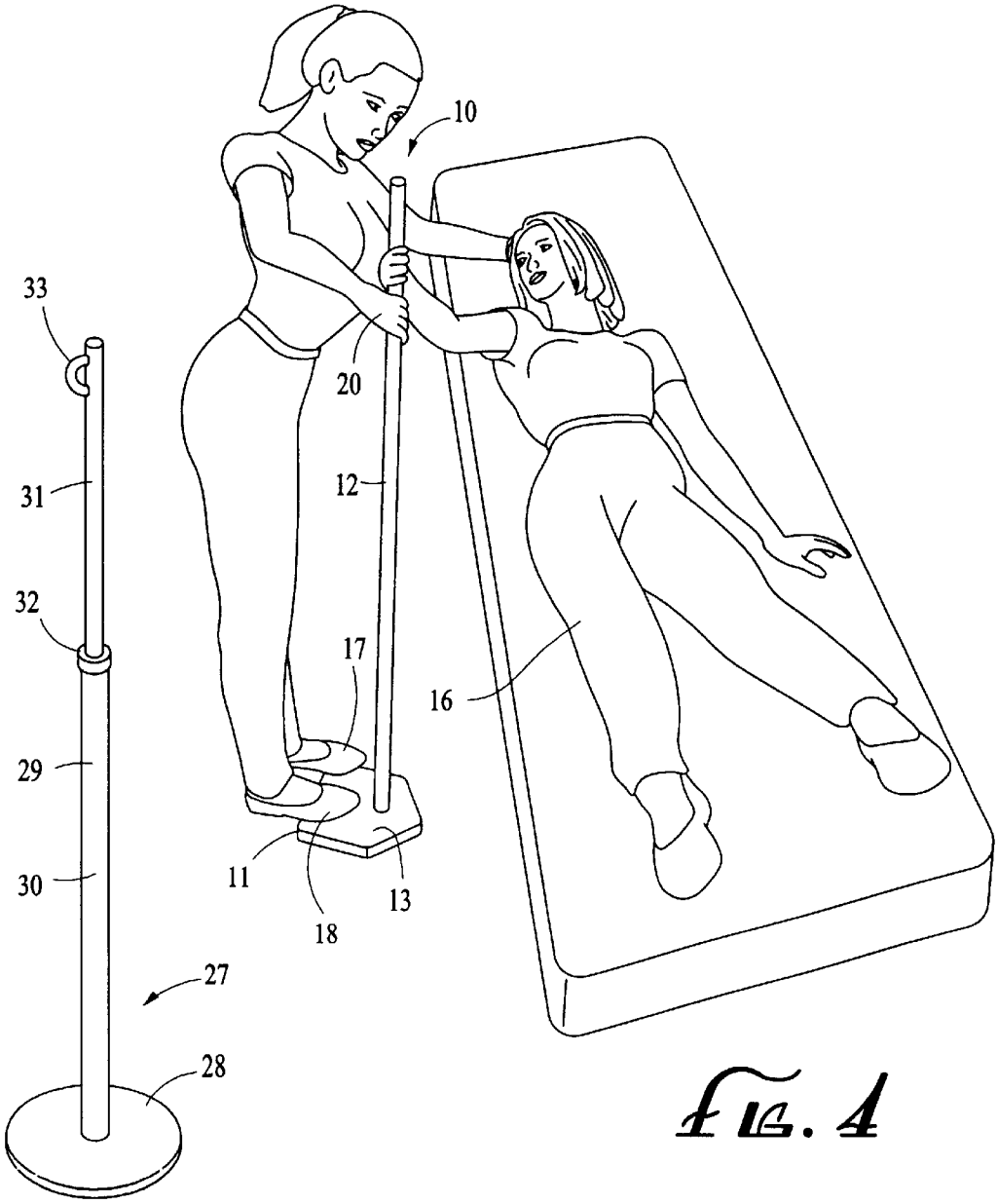
FIG. 3 is a perspective view of an alternate embodiment of the movable stand useful in the practice of the present invention.
FIG. 4 is a perspective view of a reclined person and a caregiver utilizing the movable stand of FIG. 1 to assist the reclined person to a sitting position.

The process of utilizing movable stand 10 is indicated in FIGS. 2 and 4 where caregiver 15 has moved movable stand 10 adjacent a lying person 16. The caregiver 15 and the lying person 16' both grasp the pole 12. The lying person can then lift and turn his or her upper body to a seated position as shown in FIG. 2. The caregiver 15 preferably stands on base plate 11 so that very little force is required by the caregiver 15 to hold the pole 12 vertical. Once the person is seated, caregiver 15 then places his or her foot 17 on the foot contacting upper surface 13 of movable stand 10. As shown in FIG. 1, because the caregiver is standing on base plate 11, very little force is exerted through the caregiver's hands and arms.

The floor supported base plate 11 may be large enough so that caregiver 15's other foot 18 may also be placed on the foot contacting upper surface 13. The seated person 16 is not required to place his or her feet 19 on base plate 11 and is free to move his or her feet to provide maximum support and balance.

Next, caregiver 15 grasps pole 12 with his or her hand or hands 20 and 21. Then the seated person 16 grasps the pole 12 with his or her hand or hands 22 and 23. The seated person then pulls his or herself toward the pole 12 as well as upwardly, thereby rising without requiring a significant pull by the caregiver. This is because pole 12 is basically supported by floor supported base plate 11 and the grasp by the caregiver's hands 20 and 21 can be minimal, or completely absent.

The pole should preferably be about 5 feet in height and the base plate approximately 2 feet long and 1 foot wide. It can be adjustable in height by making the pole telescoping in configuration. Pole 12 may be mounted near the front 24 of floor supported base plate 11 so that it may be placed close to the chair or bed without being held away by contact from a member, such as base board 25 of bed 26. For locations where there is space under the seat, the pole may be mounted in the center of base plate 11 which may also be circular in shape. After the seated person is standing, the movable stand can be replaced in the corner of the room or wherever it is normally stored for easy availability by others.

An alternate embodiment of the movable stand of the present invention is shown in FIG. 3 and indicated by reference character 27. Stand 27 has a circular base 28 to which pole 29 is affixed. Pole 29 has a base portion 30 into which an upper telescoping portion 31 fits. A conventional tightening nut 32 secures telescoping portion 31 at a desired height. A handle 33 may be affixed to pole 29 or to pole 12 to help the invalid to grasp the pole. The tern "reclined" as used in the claims hereon is intended to include lying down or being seated.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A process for a caregiver, using a movable stand, to assist a reclined person to move from a reclined position to a sitting or standing position, said movable stand having a floor supported base plate having a floor-contacting bottom and a foot contacting upper surface, and a generally vertical pole supported by and extending upwardly from said base plate, said process comprising:

moving said movable stand to a position adjacent the reclined person;

the caregiver placing at least one foot on the foot-contacting upper surface of said floor supported base plate;

the caregiver grasping an upper portion of said generally vertical pole; and the reclined person grasping an intermediate portion of said generally vertical pole and pulling on said pole to assist the reclined person to sit or stand without placing a strain on the back of the caregiver.

2. The process of claim 1 wherein the caregiver places both feet on the foot contacting upper surface of said floor supported base plate.

3. The process of claim 1 wherein said generally vertical pole and said floor supported base plate are fabricated from aluminum.

4. The process of claim 1 wherein said generally vertical pole is mounted near a front edge of said floor supported base plate and the front edge of said floor supported base plate is oriented toward said reclined person when said movable stand is moved in front of said reclined person.

5. The process of claim 1 wherein said generally vertical pole is mounted in the middle of said floor supported base plate and the front edge of said floor supported base plate is oriented toward said reclined person when said movable stand is moved in front of said reclined person.

* * * * *